US010194251B2

(12) United States Patent
Ginnerup et al.

(10) Patent No.: US 10,194,251 B2
(45) Date of Patent: Jan. 29, 2019

(54) TOP PORT MICROPHONE WITH ENLARGED BACK VOLUME

(71) Applicant: TDK Corporation, Tokyo (JP)

(72) Inventors: Morten Ginnerup, Kgs. Lyngby (DK); Pirmin Hermann Otto Rombach, Kongens Lyngby (DK); Jan Tue Ravnkilde, Hedehusene (DK); Dennis Mortensen, Frederiksberg C (DK); Kurt Rasmussen, Herlev (DK)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 15/764,986

(22) PCT Filed: Oct. 7, 2015

(86) PCT No.: PCT/EP2015/073146
§ 371 (c)(1),
(2) Date: Mar. 30, 2018

(87) PCT Pub. No.: WO2017/059898
PCT Pub. Date: Apr. 13, 2017

(65) Prior Publication Data

US 2018/0302725 A1 Oct. 18, 2018

(51) Int. Cl.
*H04R 19/04* (2006.01)
*H04R 1/04* (2006.01)
(Continued)

(52) U.S. Cl.
CPC ..... *H04R 19/04* (2013.01); *H04R 1/04* (2013.01); *H04R 1/083* (2013.01); *H04R 1/28* (2013.01);
(Continued)

(58) Field of Classification Search
CPC ..... H04R 19/04; H04R 19/005; H04R 1/04; H04R 1/083; H04R 1/28; H04R 2201/003;
(Continued)

(56) References Cited

U.S. PATENT DOCUMENTS 8,571,239 B2 * 10/2013 Feiertag ..... H04R 1/2884 381/174
8,624,385 B1 1/2014 Minervini
(Continued)

FOREIGN PATENT DOCUMENTS

CN 204131729 U 1/2015
CN 204131730 U 1/2015
(Continued)

*Primary Examiner* — William A Jerez Lora
(74) *Attorney, Agent, or Firm* — Nixon Peabody LLP

(57) ABSTRACT

A package for a top port microphone with an enlarged back volume. The package includes on a substrate a lid enclosing thereunder a total volume and accommodating a MEMS chip and an ASIC. A stopper seals the ASIC against the lid thereby separating and dividing the total volume under the lid in a volume extension and a remaining volume. The volume extension can be used to arbitrarily enlarge the back volume or the front volume dependent on a placement of a sound port to the volume extension or the remaining volume. A sound path connects the volume extension and a partial volume enclosed between MEMS chip and substrate.

15 Claims, 5 Drawing Sheets

(51) Int. Cl.
*H04R 1/08* (2006.01)
*H04R 1/28* (2006.01)
*H04R 19/00* (2006.01)

(52) U.S. Cl.
CPC ..... *H04R 19/005* (2013.01); *H04R 2201/003* (2013.01)

(58) Field of Classification Search
CPC ..... H04R 11/04; H04R 17/02; H04R 21/02; H04R 9/08
USPC ..... 381/91, 111, 113, 175, 122, 124, 150, 381/355, 369, 375
See application file for complete search history.

(56) References Cited

U.S. PATENT DOCUMENTS

| | | | | |
|---|---|---|---|---|
| 2011/0156176 | A1 | 6/2011 | Huckabee | |
| 2012/0275634 | A1* | 11/2012 | Leidl | H04R 19/005 381/369 |
| 2014/0306299 | A1 | 10/2014 | Kasai | |
| 2016/0297676 | A1* | 10/2016 | Pahl | B81C 1/00825 |
| 2017/0223441 | A1* | 8/2017 | Rasmussen | B81B 7/0061 |

FOREIGN PATENT DOCUMENTS

| | | | |
|---|---|---|---|
| DE | 102004011148 | B3 | 11/2005 |
| DE | 102011012295 | A1 | 8/2012 |
| EP | 2191500 | B1 | 11/2013 |
| WO | WO 2014/094831 | A1 | 6/2014 |

* cited by examiner

TOP PORT MICROPHONE WITH ENLARGED BACK VOLUME

CROSS-REFERENCE TO RELATED APPLICATIONS

This application is a U.S. National Stage of International Application No. PCT/EP2015/073146, filed Oct. 7, 2015, which is incorporated herein by reference in its entirety.

A Bottom Port-microphone comprises a package with a sound port on the bottom side of the package bearing the electric contacts. The bottom side is formed by a carrier substrate onto which top surface components of the microphone are mounted like MEMS chip and ASIC for example. The substrate usually comprises a PCB or another multilayer substrate comprising an internal wiring.

A top port microphone has a sound port on a top surface facing away from the bottom side that bears the electrical contacts. Then it is possible to arrange the MEMS chip near the sound port to provide a sufficiently big back volume. But an electrical rewiring is necessary to connect the chip terminals with the contact pads at the bottom of the package. This needs technical effort and represents a critical step in view of the microphone's performance.

In an alternative approach all internal components are mounted on the substrate as usual but the intruding sound is guided in a suitable way through a gap between the components and the substrate. Such a solution is known from DE 10 2011 012295 A1 for example. There, the MEMS chip is sealed against the top surface of the substrate by a foil thereby at the same time covering and enclosing the back volume. But this solution is unfavorable for not allowing to enhance the back volume that is enclosed within the MEMS chip.

EP 2 191 500 B1 discloses a microphone package that requires a complex and costly part for guiding the sound in a desired way from the sound port to the bottom of the membrane. A further disadvantage are high costs and missing ability for further reducing package size.

From DE 10 2004 011148 B3 it is known to brace the MEMS-chip between substrate and a lid. A rerouting of electrical and acoustic signals is not necessary but the MEMS chip that is very sensitive to stress is braced between components of the package and suffers from tolerances in size and thermomechanical movements and expansions. As a further disadvantage the MEMS internal volume is assigned to the front volume and hence lost for the microphone.

It is an object of the present invention to provide a microphone package that comprises an enlarged back volume and that is easily to manufacture.

This and other objects are solved by claim 1 of the invention. Advantageous embodiments are subject of further claims.

The invention starts from the solution similar to that one known from DE 10 2011 012295 A1 as mentioned above. All components that is a MEMS chip and an ASIC are mounted on a substrate. A lid arranged and mounted above the components on the substrate encloses a package volume that accommodates the components. A seal is used to seal MEMS chip and ASIC to the top surface of the substrate thereby separating a first partial volume between MEMS chip and lid from a second partial volume enclosed between the MEMS chip and the substrate and bounded by the seal.

According to the invention the second partial volume is enhanced by adding thereto a lateral volume extension. This extension is separated from the remaining volume (first and second partial volume) by a stopper that seals the ASIC to the lid at two opposed sidewalls and at the top inner surface. Volume extension and remaining volume are located laterally adjacent to each other and mutually communicate via a sound path through the seal. The sound path comprises an opening in the seal and is guided within the gap between AISC and substrate to the second partial volume between MEMS chip and substrate.

An assignment of first and second partial volume to front volume and back volume that are required for the function of the microphone can be made arbitrarily by providing access the volume extension or the first partial volume by a sound port that comprises an opening in the lid.

The invention allows selecting and setting a size of front volume and back volume independent from each other and independent from component sizes. The second partial volume can be enhanced by enhancing the volume of the volume extension preferably by laterally elongating the lid. The first partial volume can be enhanced by enhancing the remaining volume by properly enhancing the size of the lid in any dimension desired. A lateral extension of the remaining volume and hence of first partial volume would have no impact on the size of the second partial volume. Enhancing height or width of the lid would enhance both partial volumes.

The stopper can be made with low additional effort and is formed by a resin compressed between the ASIC and a top surface and side surfaces of and the lid as well.

The resin is preferably a soft resin like a glue. A small E modulus of the stopper in its hardened state would have low mechanical impact on the microphone components. A resin that hardens after depositing it and after mounting the lid would provide the smallest mechanical stress.

The rein for the stopper can be deposited on the ASIC by properly dispensing it. It is also possible to deposit the resin at inner walls of the lid before mounting the lid.

The stopper can also comprise an inner lining of the lid that may be prefabricated together with the lid. Such a lining can be made with more precision than a dispensing a liquid or viscous resin to the ASIC. A molded lining e.g. a soft rubber is preferred.

The invention allows mounting of components in a flip chip arrangement via a bump connection for example, or alternatively via bonding to the substrate with their backsides down by a glue or solder for example. Electrical connection of components is done via the bumps in the first variant and via bonding wires in the second variant. In the second variant, it is possible to apply the glue in a structured way that a sound path is formed by the structured glue between the components and the substrate. Thus, the glue can be used as a seal to separate first and second partial volume.

By the seal the MEMS chip and the ASIC are sealed to the substrate that a hollow space is enclosed between the bottom sides of the two components and the substrate. This space is then laterally bounded by the seal.

According to an embodiment the seal is formed by a foil laminated on top of MEMS chip and ASIC thereby extending the components, covering their side surfaces and the substrate at least in a margin surrounding the components. The sealing foil can be laminated to the entire surface. But then it needs to be structured to provide free access to the sound path that communicates with the membrane and the volume extension.

The lid is preferably a prefabricated metallic cap. The bottom edges of the lid are mounted to the substrate by a glue for example. The glue may be electrical conductive that the lid may be grounded by bonding it to a respective metallic ground pad on the top of substrate. But it is also possible to use solder for mounting the lid to an according metallized surface of the substrate.

According to an embodiment the MEMS chip comprises a capacitive MEMS microphone. But any other type of MEMS microphone can be used too.

The sound port comprises an opening in the lid and connects the front volume to an atmosphere exterior to the microphone package. First and second partial volume can alternatively be used as front volume. In the second alternative the sound port is provided above the volume extension. In the first alternative the sound port is provided as an opening to the first partial volume and is preferably located above the MEMS chip.

But generally it would be possible too to provide the opening for the sound port in the substrate. The microphone would then be bottom port microphone.

The substrate may comprise a printed circuit board made from an organic multilayer laminate or a multilayer ceramic. In both cases at least a wiring layer is present in the PCB to make interconnections between MEMS chip and ASIC, between ASIC and external terminals at the bottom of the substrate, and between MEMS chip and external terminals. If two wiring planes are present crossing of conductor lines can be avoided.

In the following the invention will be explained in more detail while referring to specific embodiments and the corresponding figures. The figures are schematic only and not drawn to scale. Specific parts can be depicted in an enlarged way to allow better grasping the invention. So, neither absolute sizes nor size relations can be taken from the figures. To the same parts or to parts that have the same function will be referred to by the same reference symbols.

FIGS. 1*a* and 1*b* show different cross sections of a microphone known from the art FIG. 2 shows a cross section of a first embodiment.

Figure 5A:
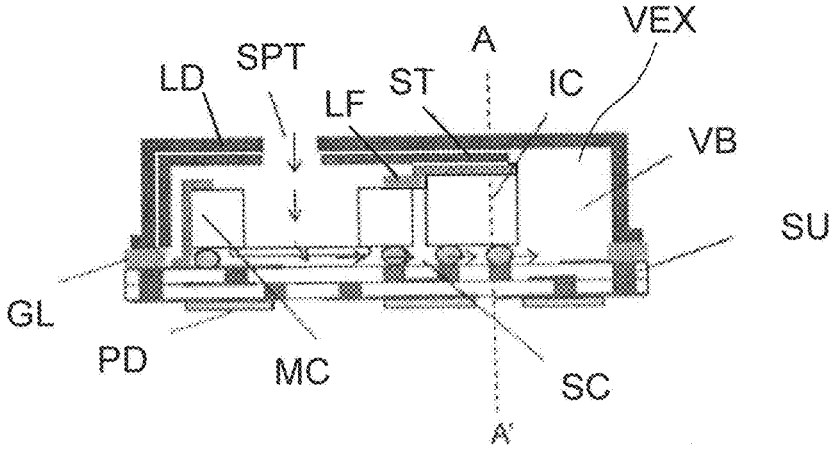
Figure 5B:
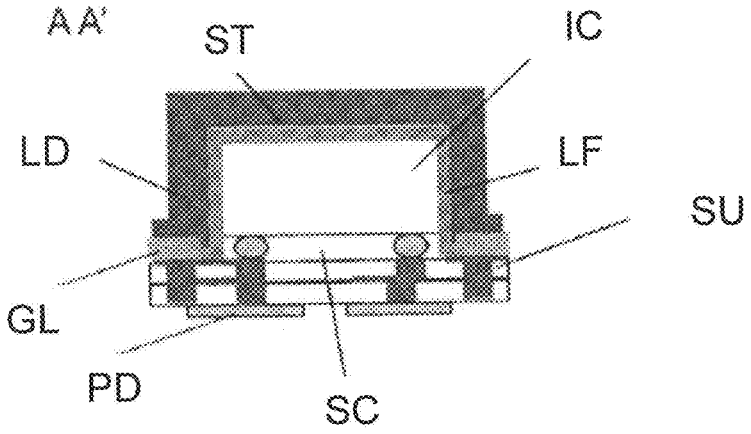

FIGS. 5*a* and 5*b* show different cross sections of a microphone according to a third embodiment.

Figure 6A:
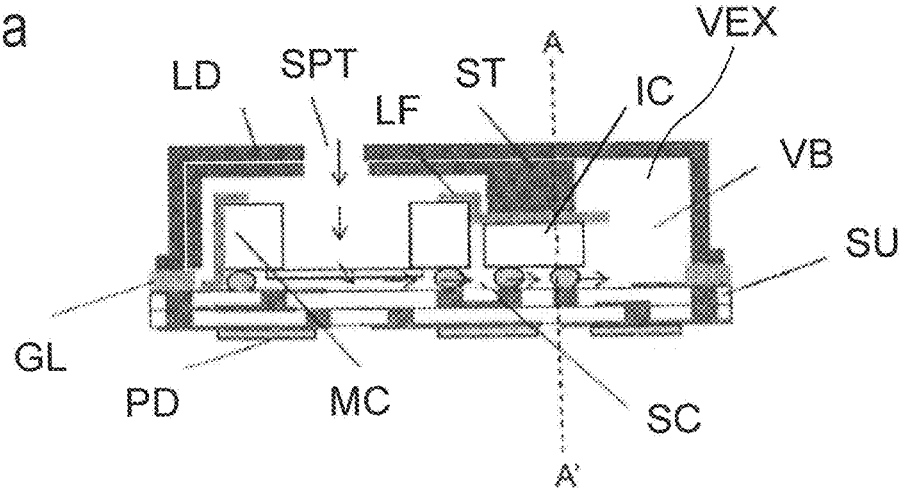
Figure 6B:
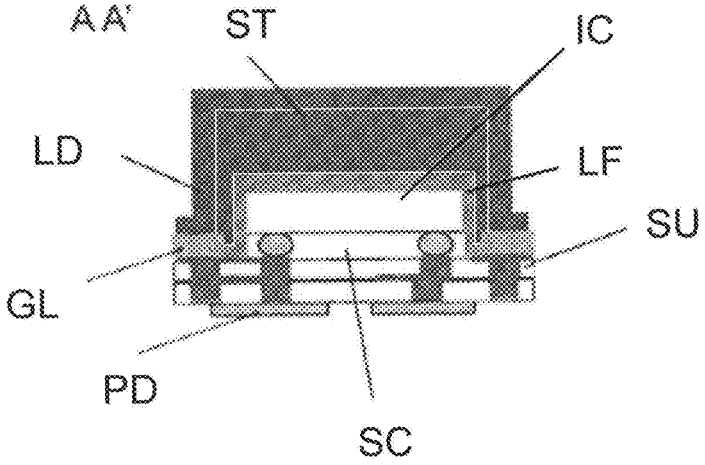

FIGS. 6*a* and 6*b* show different cross sections of a microphone according to a fourth embodiment.

FIGS. 7*a* to 7*d* show different cross sections of a microphone according to a fifth embodiment.

Figure 1A:
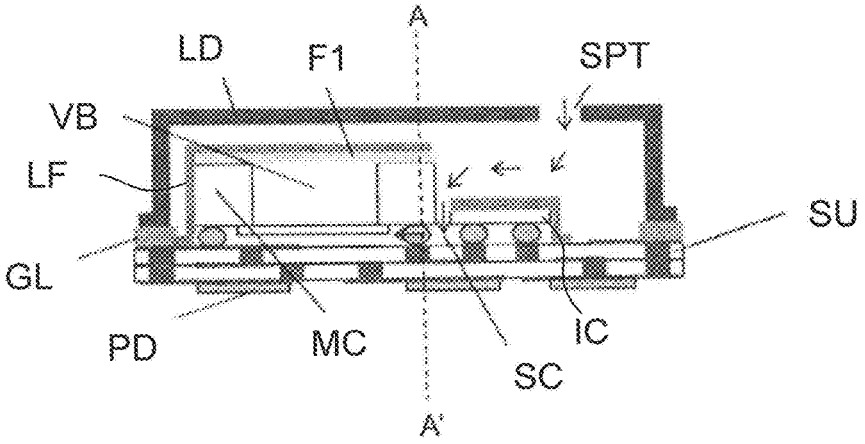
Figure 1B:
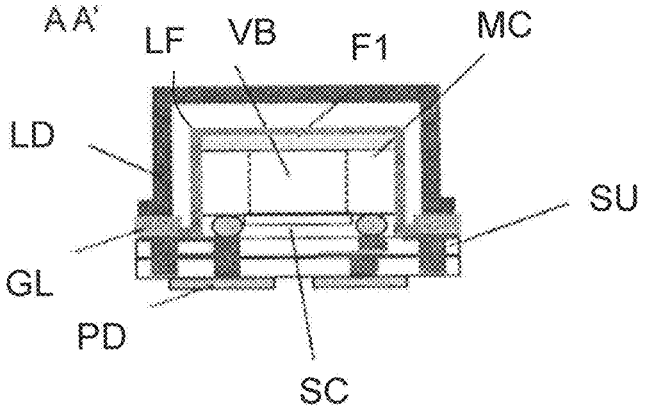

FIGS. 1*a* and 1*b* show different cross sections of a top port microphone known from the art. A MEMS chip MC and another chip that is an ASIC IC are mounted on a PCB functioning as a substrate SU. The pads for electrical contacting the microphone are arranged at the bottom surface of the substrate. Both chip components are enclosed under a lid LD that is glued and sealed to the substrate SU by an adhesive. MEMS chip MC and ASIC IC are sealed to the substrate with a laminate foil FL. A recess in the MEMS chip MC above the membrane MM thereof is covered and thus protected by a first foil F1 arranged under a laminate foil LF. The recess forms the back volume VB of the microphone. The front volume is formed by the remaining volume enclosed under the lid LD. A sound port SPT in the lid LD makes the front volume VF communicating with the exterior atmosphere. An opening in the laminate foil FL provides access to a sound path SC below the MEMS chip MC to the membrane MM of the microphone. FIG. 1*b* shows another cross section along AA indicated in FIG. 1*a*. Back volume VB and sound path SC can easily be identified.

This known microphone restricts the back volume VB to the volume of the recess and hence to the size of the MEMS chip MC. By the large front volume in connection with the relative small back volume the high audio frequency performance of the microphone is deteriorated.

Figure 2:
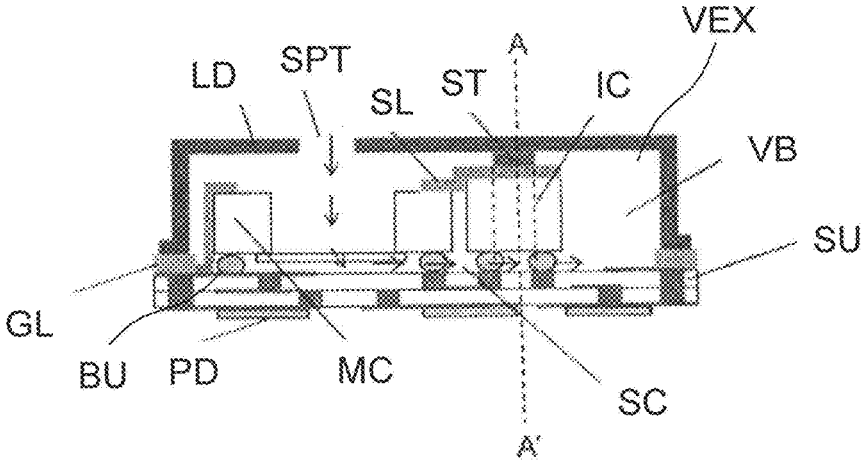

FIG. 2 shows a first embodiment of the invention. A first partial volume V1 of the total volume under the lid LD is enclosed between MEMS chip MC and lid LD and comprises the recess in the MEMS chip. A second partial volume V2 is enclosed between MEMS chip MC and substrate SU. The enclosure under the MEMS chip is made tight by applying a seal over MEMS chip and ASIC that seals against the chips (MEMS and ASIC) and against the substrate SU.

Figure 4:
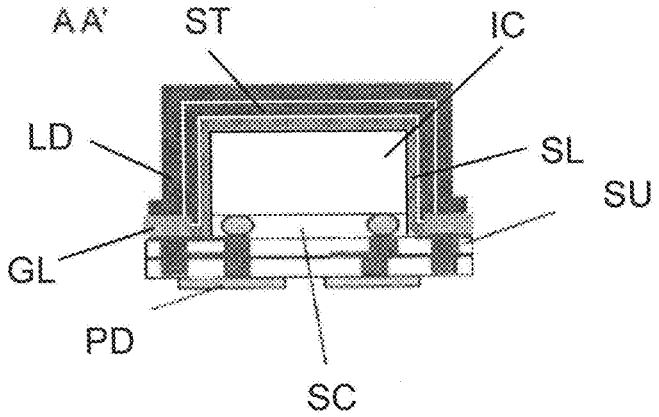
FIG. 4 shows a further cross section of the first and the second embodiment.

In an area around the ASIC the ASIC IC is sealed to the lid LD by a stopper ST that fills up the gaps between top and side surfaces of the ASIC and the lid LD. The stopper can be applied by a dispenser or a similar apparatus as a liquid resin of sufficient viscosity to allow a structured deposition on top and side surfaces of the ASIC before mounting the lid. When attaching and mounting the lid to the substrate the resin of the seal SL gets compressed between lid and ASIC such that the gap is completely filled out without any remaining spaces. Hence, the stopper ST and the ASIC IC separate a volume extension VEX from the remaining volume under the lid. Only a gap between ASIC IC and substrate SU remains free and provides a sound path from the volume extension VEX to the membrane MM of the MEMS chip MC. FIG. 4 shows a cross section along AA' as indicated in FIG. 2. ASIC IC and stopper completely fill up the cross section with the exception of the sound path SC.

Similar like the microphone of FIG. 1*a* MEMS chip MC and ASIC IC are sealed and covered by a laminate foil SL applied over MEMS chip and ASIC, extending the edges thereof, and sealing to the substrate SU in a margin around MEMS chip and ASIC. Above the recess of the MEMS chip the seal SL is removed that the first partial volume V1 comprises the recess. The second partial volume V2 comprising the sound path SC is sealed against first partial volume V1 by the seal SL. The sound path SC connects second partial volume V2 and volume extension VEX.

A laminate foil that can be used as a seal preferably comprises an elastomeric sheet that has some adhesive properties by comprising uncured groups like epoxy groups.

According to the first embodiment and the first alternative a sound port SPT comprises an opening in the lid LD above the MEMS chip MC thereby assigning the first partial volume V1 to the front volume VF. Back volume VB is formed by volume extension VEX, sound path SC and second partial volume V2.

Figure 3:
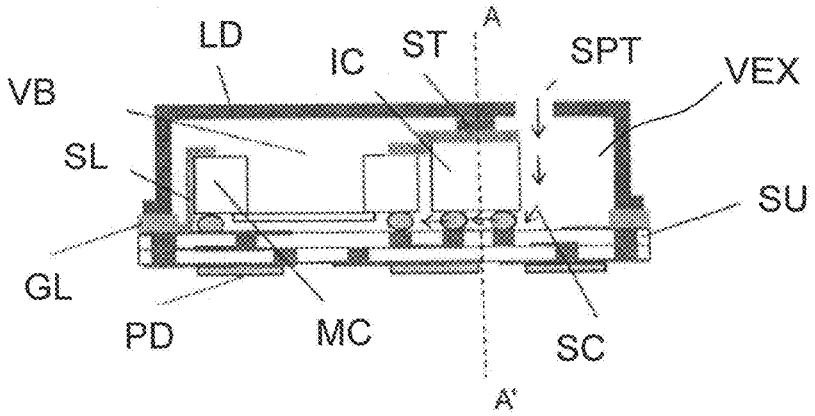
FIG. 3 shows a cross section of a second embodiment.

According to a second embodiment shown in FIG. 3 that is a second alternative the sound port SPT comprises an opening in the lid LD above the volume extension VEX thereby assigning the first partial volume V1 to the back volume VB. Front volume VF is formed by volume extension VEX, sound path SC and second partial volume V2. A stopper ST is formed like in the first embodiment such that both embodiments have the same cross section along AA' according to and shown in FIG. 4.

FIGS. 5*a* and 5*b* show different cross sections of a third embodiment of the invention characterized by a different implementation of the seal SL. Here, an inner lining made from a soft rubber and be applied to the inner surface of the lid functions as a seal. The lining can be applied by a molding process that is executed separate from mounting the lid to the substrate in view of time and location. The seal/ling can comprise a conformal layer lining at least the area of the lid that bounds to the first partial volume V1. As this lining then comprises a hardened resin the sealing by the seal has to be realized by compression of the ling/seal when mounting the lid to the substrate SU and over the components. But it is possible to apply the seal to the inner surface of the lid LD in liquid form short before mounting the lid such compression thereof only needs to displace excess resin. In both cases a sufficient tight seal is yielded. Liquid seal has the advantage that a bigger tolerance is possible and compression forces can be kept low enough. A lining of the lid has already been hardened before mounting the lid allows an easier manufacture but needs higher control during mounting.

FIG. 5*a* shows the seal SL applied as an inner lining of the lid having nearly constant layer thickness. FIG. 5*b* shows that the same sealing can be yielded like in the first and second embodiment shown in FIG. 4.

In principle the sound port SPT of the microphone can placed as shown in FIG. 5*a* above the MEMS chip that the front volume is assigned to the first partial volume V1. But placement of the sound port SPT over the volume extension VEX is also possible.

FIGS. 6*a* and 6*b* show different cross sections of a fourth embodiment of the invention characterized by a realization of the seal SL that combines second and third embodiment. In this fourth embodiment an inner lining of the lid comprises a layer of a hardened sealing mass. Additional, a viscous seal is applied to the ASIC or to the lid in the area of the ASIC IC. By doing so the mounting tolerance is enhanced and the quality of the sealing can also be guaranteed with an ASIC of lower size. But it also possible to produce the total seal in form of a molded inner lining only but with a stepped layer thickness to bridge and seal the greater gap between ASIC and lid LD due to the smaller size of ASIC IC.

At microphones according to first to fourth embodiment the chips MEMS and ASIC are mounted to the substrate in a flip chip arrangement using bumps BU for mounting and electrical connection. According to fifth embodiment shown by FIGS. 7*a* to 7*d* the chips can be mounted by bonding their backsides to the substrate via an adhesive or solder. Bonding wires are used to make the electrical connections between contacts on the active top surfaces of the chips and metallic pads on the top surface of the substrate.

FIGS. 7*a* to 7*d* show different cross sections through a microphone according to this embodiment. As the bonding wires can stand only low mechanical impact the stopper requires a liquid resin to be applied to the top of the ASIC in order not to damage the wires when mounting the lid that needs compressing the stopper.

Another difference to the flip chip arrangement is the volume of the MEMS' recess that is assigned to the second partial volume. The membrane MM faces to the top and seals and covers the recess. Hence, no laminate foil or any other seal must be applied on top of the MEMS chip MC. Further, the glue that is used for mounting MEMS chip and ASIC can function as seal for separating first and second partial volume V1, V2 at the bottom edges of the MEMS chip.

Figure 7A:
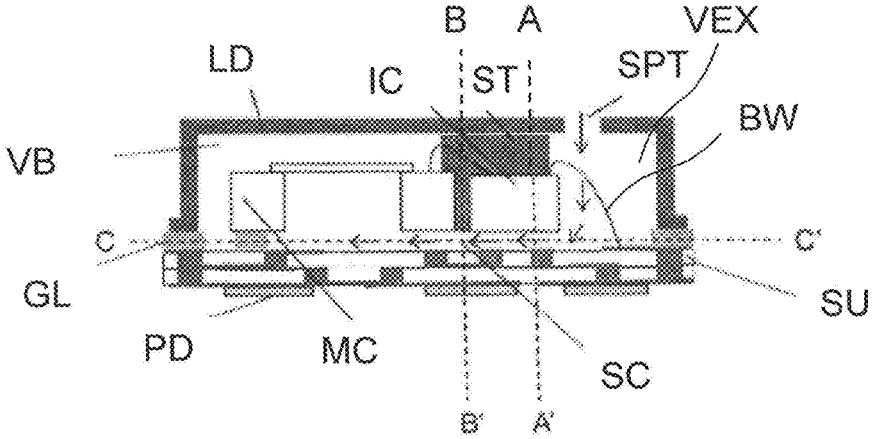
Figure 7B:
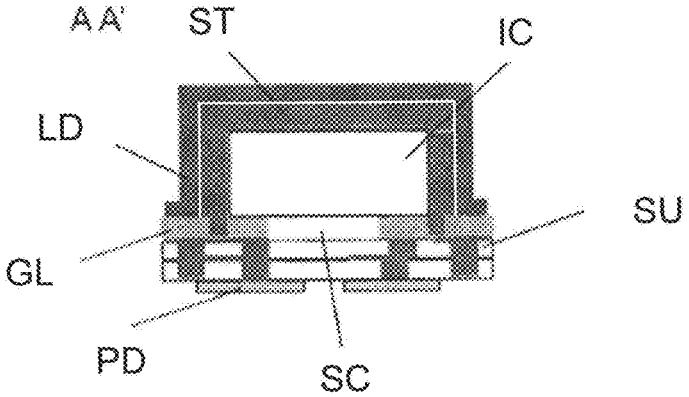
Figure 7C:
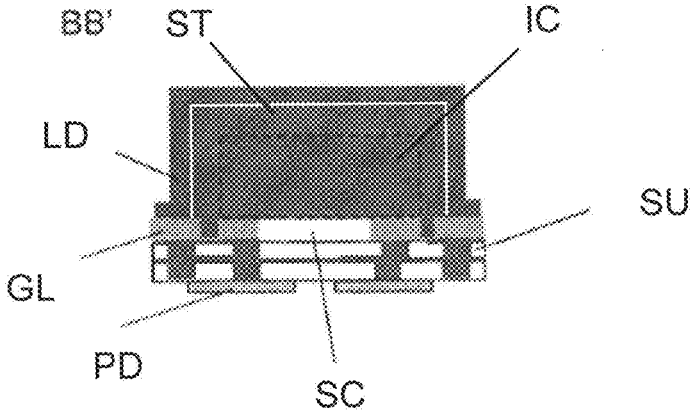
Figure 7D:
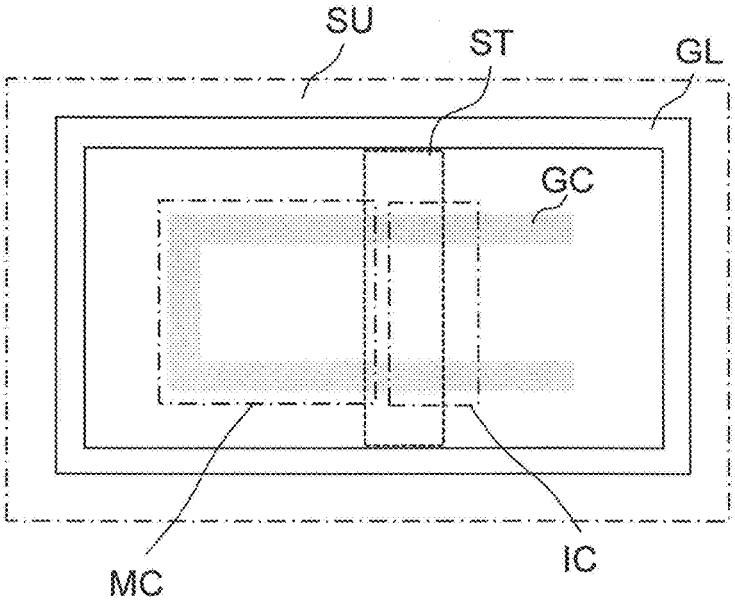

FIG. 7*d* is a cross section parallel to the surface of the substrate through the structured glue GC. The glue GC is applied in the shape of a U that is open to the volume extension VEX. The shapes of chips MC and IC as well as of substrate SU and stopper ST are marked by dotted lines.

FIG. 7*b* shows a cross section along BB' that is through the gap between ASIC and MEMS chip. It is shown that the gap is completely closed by the stopper at least at the edges of the chips. FIG. 7D shows that the stopper covers the gap between MEMS chip MC and ASIC IC. Preferably the gap is completely filled with a resin of the stopper as shown in FIG. 7*c*. The U-shaped glue GC prevents the resin of the stopper from intruding into the sound path SC enclosed between the legs of the U.

FIG. 7*b* is a cross section along AA' and shows the function of the stopper. As a stopper a liquid resin applied to the ASIC and/or the lid LD as well can be used. The seal that is achieved thereby separates volume extension from remaining volume.

The invention has been described by a few embodiments only and is hence not restricted to the described examples or drawings. A lot of variations are possible in view of shapes and materials. In spite of being explained for specific embodiments only single features can be used in other combinations too to provide further embodiments of the invention.

LIST OF REFERENCE SYMBOLS

F1 First foil to cover and protect the recess of MC
GL Glue for mounting lid to substrate
GM Glue for mounting chips to substrate
IC ASIC
LD Lid
MC MEMS chip
MM Membrane
PD Pad
SC Sound path, connecting second partial volume and volume extension
SL Seal, sealing the MEMS chip to the substrate and separating first and second partial volume (e.g. a sealing foil)
SPT Sound port
ST Stopper, sealing between ASIC and lid, separating volume extension from a remaining volume that accommodates the MEMS chip
SU Substrate
V1 First partial volume (between lid and MEMS chip)
V2 Second partial volume (between MEMS chip and substrate)
VB Back volume
VEX Volume extension (of second partial volume)
VF Front volume

The invention claimed is:

1. Microphone package comprising:

a substrate;

a lid connected and sealed to the substrate such that a volume is enclosed between lid and substrate;

a MEMS chip and an ASIC accommodated in the volume and mounted on the substrate;

a stopper sealing between ASIC and lid, separating a volume extension from the remaining volume that accommodates the MEMS chip;

a first partial volume between MEMS chip and lid;

a second partial volume between MEMS chip and substrate;

a seal sealing the MEMS chip to the substrate and separating first and second partial volume;

a sound path connecting second partial volume and volume extension thereby assigning the volume extension to the second partial volume, wherein first and second partial volume are respectively assigned to one of front volume and back volume of the microphone.

2. The microphone package of claim 1
wherein the stopper is formed by a resin compressed between a top surface of the ASIC and the lid, and between side surfaces of the ASIC and the lid.

3. The microphone package of claim 1,
wherein MEMS chip and ASIC are mounted to the substrate in a flip chip arrangement.

4. The microphone package of claim 1,
wherein the seal seals the MEMS chip and the ASIC to the substrate,
wherein the seal is formed by a laminated foil that is structured to provide a free access to the membrane from the top and an access to the sound path from the volume extension.

5. The microphone package of claim 1,
wherein MEMS chip and ASIC are mounted to the substrate with a respective back side thereof by a glue and electrically connected via wire bonding,
wherein the glue separates first and second partial volume but provides access to the sound path from the volume extension.

6. The microphone package of claim 1,
wherein the lid is connected and sealed to the substrate by a glue.

7. The microphone package of claim 6,
wherein the lid is made from a preformed metallic cap.

8. The microphone package of claim 1,
wherein the MEMS chip comprises a capacitive MEMS microphone.

9. The microphone package of claim 8,
wherein the sound port comprises an opening in the lid and connects the front volume to an atmosphere exterior to the microphone package.

10. The microphone package of claim 9,
wherein the substrate comprises a printed circuit board made from an organic multilayer laminate or a multilayer ceramic.

11. The microphone package of claim 10,
wherein the stopper comprises an inner lining applied to the interior surface of the lid.

12. The microphone package of claim 2,
wherein MEMS chip and ASIC are mounted to the substrate in a flip chip arrangement.

13. The microphone package of claim 2,
wherein the seal seals the MEMS chip and the ASIC to the substrate,
wherein the seal is formed by a laminated foil that is structured to provide a free access to the membrane from the top and an access to the sound path from the volume extension.

14. The microphone package of claim 3,
wherein the seal seals the MEMS chip and the ASIC to the substrate,
wherein the seal is formed by a laminated foil that is structured to provide a free access to the membrane from the top and an access to the sound path from the volume extension.

15. The microphone package of claim 2,
wherein MEMS chip and ASIC are mounted to the substrate with a respective back side thereof by a glue and electrically connected via wire bonding,
wherein the glue separates first and second partial volume but provides access to the sound path from the volume extension.

* * * * *